United States Patent [19]

Wenker

[11] Patent Number: 5,030,072

[45] Date of Patent: Jul. 9, 1991

[54] CONSTANT RADIAL CLEARANCE GEROTOR DESIGN

[75] Inventor: Wayne B. Wenker, Minnetonka, Minn.

[73] Assignee: Eataon Corporation, Cleveland, Ohio

[21] Appl. No.: 587,505

[22] Filed: Sep. 24, 1990

Related U.S. Application Data

[63] Continuation-in-part of Ser. No. 208,705, Jun. 20, 1988, abandoned.

[51] Int. Cl.[5] ..... F01C 1/10; F03C 2/08; F04C 2/10

[52] U.S. Cl. ..... 418/61.3; 418/171; 29/888.025

[58] Field of Search ..... 418/61.3, 150, 166, 418/171; 29/156.4 R, 888.025; 74/462

[56] References Cited

U.S. PATENT DOCUMENTS 4,504,202 3/1985 Saegusa ..... 418/150

FOREIGN PATENT DOCUMENTS 60-65293 4/1985 Japan ..... 418/61.3

*Primary Examiner*—John J. Vrablik

*Attorney, Agent, or Firm*—L. J. Kasper

[57] ABSTRACT

An improved gerotor gear set and an improved method of selecting design parameters therefore are provided. The gerotor gear set (11) includes an inner rotor (17) defining a tip radius (TR), and an outer rotor (13). The axes of the rotors are offset by an electricity (E). The profile of the inner rotor is generated by a theoretical internal tooth (15) having a generating radius (GR). The relative orbital and rotational motion of the rotors defines, alternately, a single point clearance (SPC) and a double point clearance (DPC). Iterative adjustments are made in the tip radius (TR) and the generating radius (GR) until both the SPC and DPC are approximately equal to a desired tip clearance (TC).

10 Claims, 4 Drawing Sheets

CONSTANT RADIAL CLEARANCE GEROTOR DESIGN

This application is a continuation-in-part of Application Ser. No. 208,705, filed June 20, 1988, abandoned.

BACKGROUND OF THE DISCLOSURE

The present invention relates to gerotor gear sets, and more particularly, to methods of selecting design parameters of gerotor gear sets.

As is well known to those skilled in the art, a gerotor gear set of the type to which the present invention relates includes an inner rotor having a plurality N of external teeth, and an outer rotor having a plurality N+1 of internal teeth. The axis of the inner rotor is offset from the axis of the outer rotor by an eccentricity E. Relative orbital and rotational motion of the inner and outer rotors defines a plurality of expanding and contracting volume chambers, whereby gerotor gear sets are useful as fluid displacement devices. Typical examples of commercial uses of gerotor gear sets are in low-speed, high-torque hydraulic motors, hydraulic pumps, and hydrostatic steering control valves.

The term "gerotor" is a shorthand expression for the phrase "GEnerated ROTOR", because one member of the gerotor gear set includes a set of teeth or lobes which are conventionally circular, and the other member of the gear set has a profile which may be considered as having been "generated" by the lobes of the first member.

One important aspect of the design of a gerotor gear set is the mathematical relationship (clearance or interference) between the adjacent lobes or teeth of the two members (rotors). Although the present invention is not limited to any particular application of the gerotor gear set, it is important to recognize that the eventual application of the gerotor gear set, and the fluid pressure to which it is subjected, will determine the nominal, radial tip clearance between the external teeth of the inner rotor and the internal teeth of the outer rotor. For example, when a gerotor gear set is used in a hydrostatic power steering unit, there must be a positive clearance between the inner and outer rotor so that there is no binding of the rotors as the vehicle operator rotates the vehicle steering wheel. On the other hand, when a gerotor gear set is being used in a low-speed, high-torque hydraulic motor, subject to a pressure differential of 2,000 or 3,000 psi, or more, the gerotor gear set must be designed to have a nominal, radial tip clearance which is at least mathematically an interference fit, to compensate for the effect of pressure on the outer rotor, so that there is still the proper sealing between high-pressure volume chambers and low-pressure volume chambers.

A gerotor gear set has two important sealing points, which occur alternately, during relative orbital and rotational motion of the rotors. The first is a single point clearance (SPC), and the second is a double point clearance (DPC). In the case of a gerotor gear set which must not have any interference or binding, if the design values of SPC and DPC are different, the predicted manufacturing tolerance would make it necessary to select a tip clearance larger than is actually desired, in order to prevent any possibility of radial interference. The result is that the gerotor gear set will have a lower volumetric efficiency than if the design values of SPC and DPC had been the same. Similarly, if the application for the gerotor gear set requires a certain minimum interference fit, the design error or difference between the design SPC and DPC will make it necessary to increase the maximum interference fit (decrease the tip clearance further in the negative direction). This will result in a decreased mechanical efficiency.

SUMMARY OF THE INVENTION

Accordingly, it is an object of the present invention to provide an improved gerotor gear set in which the radial tip clearance between the inner rotor and the outer rotor will be more consistent and closer to the predetermined tip clearance.

It is a related object of the present invention to provide a method of selecting design parameters of a gerotor gear set which will result in a design in which the clearances at the sealing points (SPC and DPC) will be more consistent, and closer to the desired tip clearance.

The above and other objects of the invention are accomplished by the provision of a method of selecting design parameters of a gerotor gear set of the type including an inner rotor having a plurality N of external teeth defining a tip radius TR, and an outer rotor having a plurality N+1 of internal teeth. The axis of the inner rotor is offset from the axis of the outer rotor by an eccentricity E. Theoretical generation of the profile of one of the rotors is accomplished by a theoretical tooth of the other rotor, the theoretical other tooth having a generating radius GR. Relative orbital and rotational motion of the inner and outer rotors defines, alternately, a single point clearance SPC, and a double point clearance DPC between the external teeth of the inner rotor and the internal teeth of the outer rotor.

The method is characterized by:

(a) first, selecting the desired radial tip clearance TC between the external teeth of the inner rotor and the internal teeth of the outer rotor, then (b) iteratively adjusting either the tip radius TR or the generating radius GR by an amount equal to or less than the difference between the desired tip clearance TC and either the single point clearance SPC or the double point clearance DP; and (c) repeating step (b) until both the SPC and the DPC are approximately equal to the desired tip clearance TC, within an acceptable tolerance.

DESCRIPTION OF THE PREFERRED EMBODIMENT

Figure 1:
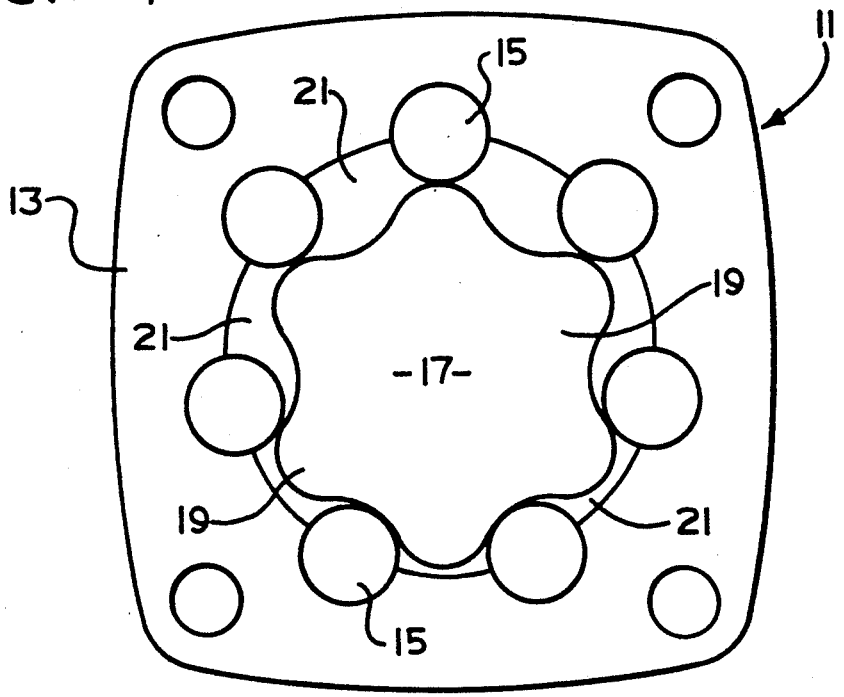
FIG. 1 is a plan view of a roller gerotor gear set of the type to which the present invention relates.

Referring now to the drawings, which are not intended to limit the invention, FIG. 1 illustrates a roller gerotor gear set of the type which may be used in various hydraulic products such as low-speed, high-torque motors of the type described in U S. Pat. No. 4,533,302, assigned to the assignee of the present invention and incorporated herein by reference.

Gerotor gear sets of the type shown in FIG. 1 may also be utilized in a variety of other fluid displacement or fluid transfer products such as hydraulic pumps, fuel pumps, and as the metering device in a hydrostatic power steering control unit of the type sold by the assignee of the present invention under the trademark "Orbitrol" steering control unit. It should be clearly understood that the eventual use of the gerotor gear set does not, in any way, limit the scope of the present invention.

FIG. 1 illustrates a roller gerotor gear set which is sold, generally as part of a hydraulic motor, by the assignee of the present invention under the trademark "Geroler" gear set. The gear set, generally designated 11, comprises an internally toothed ring member 13 (also referred to as the outer rotor), which defines a plurality of generally semi-cylindrical pockets or openings. A cylindrical roller member 15 (also referred to as a lobe) is disposed in each of the openings, to comprise the internal teeth of the ring 13. Therefore, the use hereinafter of the term "gerotor" will be understood to include both a roller gerotor of the type shown in FIG. 1, as well as a conventional gerotor in which the internal lobes or teeth are formed integrally with the ring member 13. Eccentrically disposed within the ring 13 is an externally toothed star 17 (also referred to as the inner rotor). The star 17 includes a plurality of external teeth or lobes 19.

In gerotor gear sets of the type to which the present invention relates, the star 17 has a plurality N of external teeth 19, whereas the ring 13 has a plurality N+1 of the internal teeth or rollers 15. Therefore, in the subject embodiment of the invention, N is equal to 6 (and N+1 is equal to 7), although the present invention is equally applicable to gerotor gear sets in which N is either less than 6 or greater than 6, and N may be either an even number or an odd number. Thus, the star 17 is able to orbit and rotate relative to the ring 13, the relative orbital and rotational movement defining a plurality of expanding and contracting volume chambers 21. It will be understood by those skilled in the art that, within the scope of the present invention, either the ring 13 or star 17 can be the member having orbital movement, or the member having rotational movement.

Figure 5:
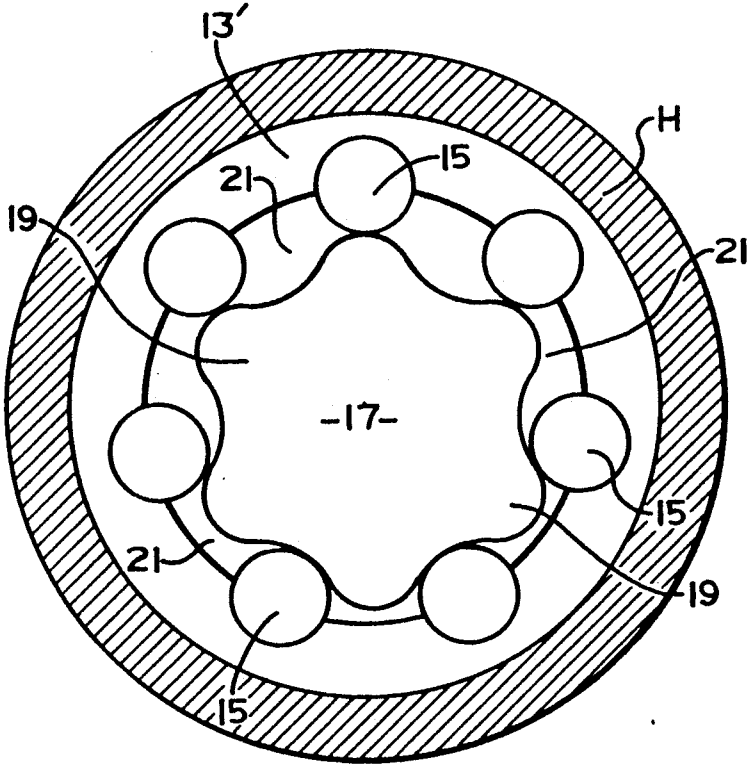
FIG. 5 is a plan view of an alternative embodiment of a roller gerotor gear set of the type to which the present invention relates.

Referring no too FIG. 5, there is illustrated a "fixed axis" roller gerotor gear set in which the star 17 rotates about its axis, a rotatable ring 13" (outer rotor), rotates, within a housing H, about its axis, and the two axes remain "fixed" within the device relative to each other.

Figure 6:
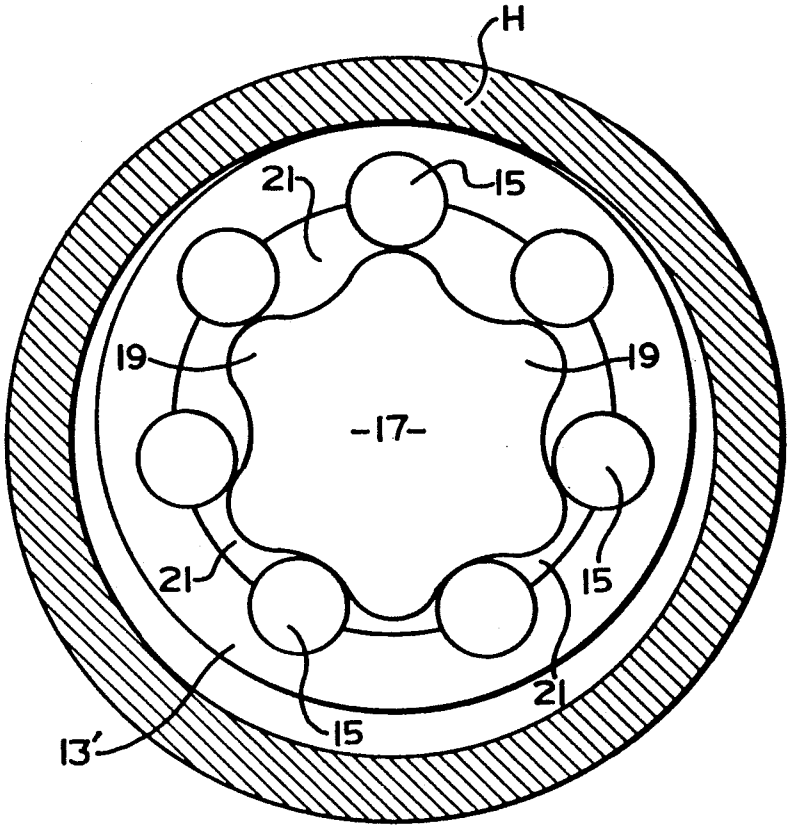
FIG. 6 is a plan view of a further alternative embodiment of a roller gerotor gear set of the type to which the present invention relates.

Referring now to FIG. 6, there is illustrated an "orbiting ring" type of roller gerotor gear set in which the star 17 rotates about its axis, and the ring 13' "orbits" within the housing H.

Referring now to FIG. lA, there is shown an enlarged, fragmentary view of the gerotor gear set of FIG. 1, for the purpose of illustrating certain additional parameters of the gerotor gear set 11. The ring 13 defines an axis of rotation 23, while the star 17 defines an axis of rotation 25, with the transverse distance between the axes 23 and 25 comprising the eccentricity E of the gerotor gear set 11. The axes 23 and 25 cooperate to define an imaginary line of eccentricity LE. As is well known to those skilled in the art, in the case of a gerotor gear set in which the ring 13 is stationary and the star 17 orbits and rotates, the line of eccentricity LE pivots about the axis 23 of the ring 13 at the speed of, and in a direction opposite to, the orbital motion of the star 17. The physical significance of the line of eccentricity LE, which is also well known to those skilled in the art, is that with the star 17 assumed to be orbiting clockwise in FIG. 1 and lA, the volume chambers 21 to the right of the line of eccentricity LE are instantaneously expanding, whereas those volume chambers on the left of the line LE are contracting.

Referring still to FIG. lA, the radial distance from the axis 25 of the star 17 to the tip of each of the external teeth or lobes 19 is referred to as the tip radius TR. The radial distance from the axis 23 of the ring 13 to the center of each of the rollers or lobes 15 is the lobe base radius LBR. Finally, the radius of each of the teeth or lobes 15 is referred to as the lobe radius LR.

Figure 2:
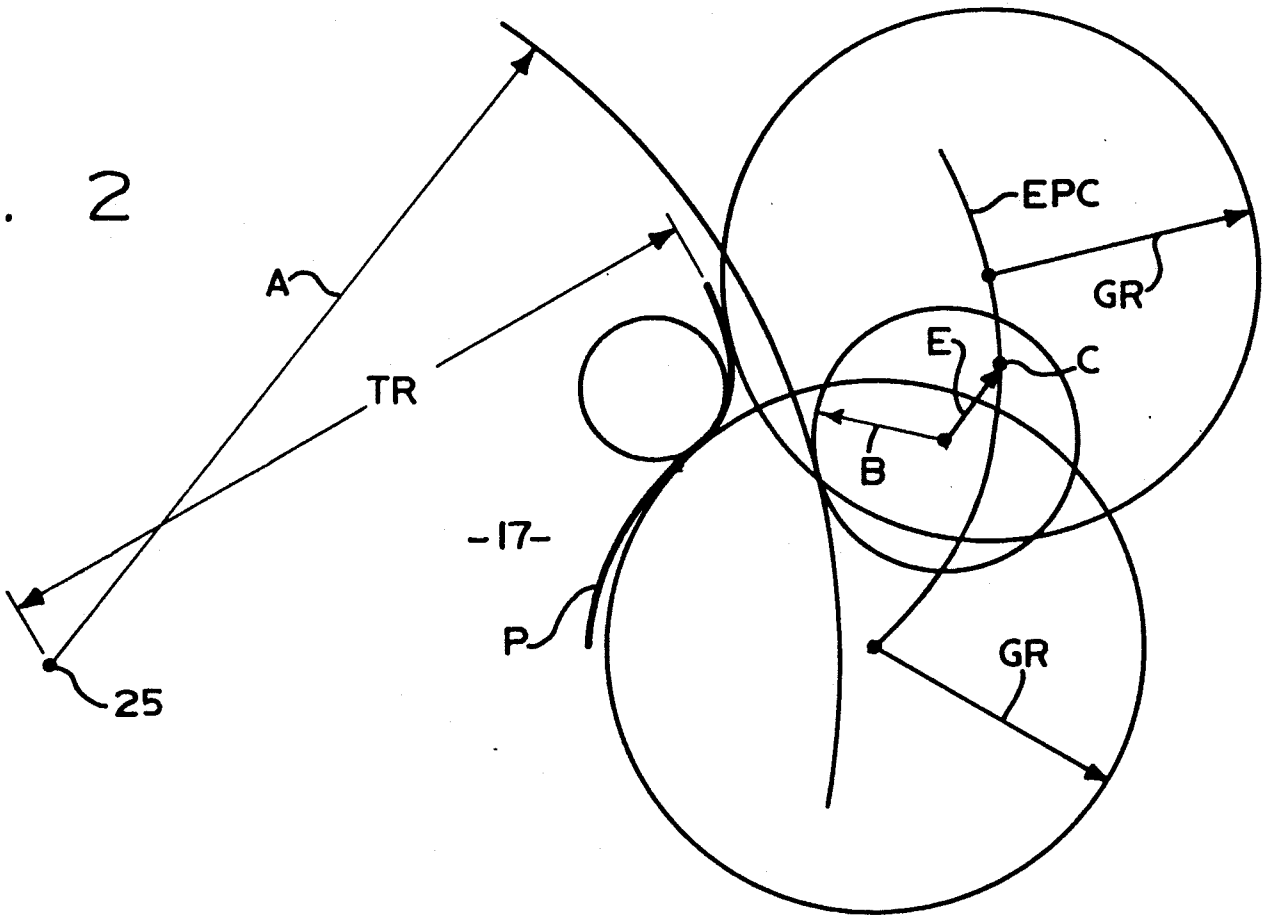
FIG. 2 is a somewhat diagrammatic illustration of the method of generation, of a gerotor star, to which the present invention relates.

Referring now primarily to FIG. 2, there is illustrated the conventional method for generating the star 17, also referred to as an externally-generated rotor (EGR). It will be understood by those skilled in the art that the present invention is equally applicable to an internally-generated rotor (IGR). The generation method illustrated in FIG. 2 will be described herein in just enough detail to provide a basis for describing the invention, because the basic, geometric method of generation is well known to those skilled in the art, and forms no direct part of the present invention.

In generating the profile of the star 17, it is necessary to begin with various parameters as "givens", including the eccentricity E of the star 17 within the ring 13; the tip TR of the star 17; and the number of star teeth N. It is also necessary to select a generating radius GR, which represents the radius of a theoretical cutting tool used to cut a form or profile P of the star 17. Theoretically, and as a beginning point, the generating radius GR may be selected to be equal to the lobe radius LR.

The first step in laying out the generation method is to define a large circle of radius A, wherein radius A is equal to or greater than the selected tip radius TR. At the same time, a smaller circle is placed tangent to the larger circle, the smaller circle having a radius B, wherein B equals A divided by N. Within the smaller circle, a point C is defined by drawing a radial line, starting at the center of the smaller circle and extending a distance equal to the eccentricity E. The next step is to generate an epicycloid EPC by rolling the smaller circle around the larger circle, with the locus of all the points C comprising or defining the epicycloid EPC. The final step is to "place" the center of the generating circle, having the generating radius GR, on the epicycloid EPC, and then move the center of the generating circle (theoretical cutting tool) along the entire epicycloid EPC, until the generating circle returns to its original position. The locus of all the points tangent to the generating circle (two positions of the circle being shown in FIG. 2), comprises the generated profile P of the star 17.

Figure 3:
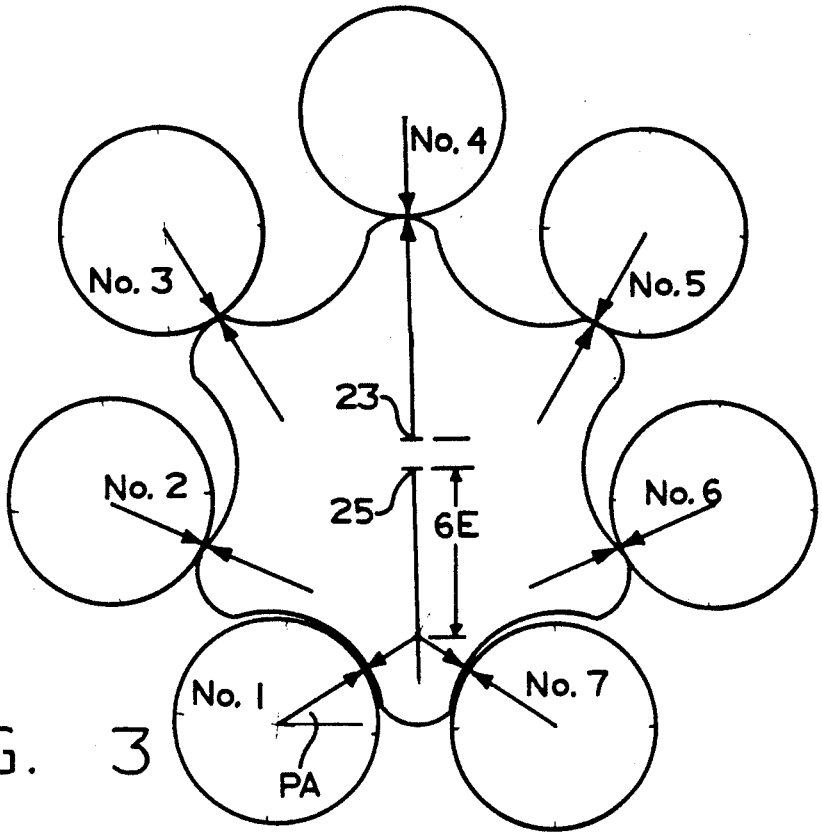
FIG. 3 is an outline view of a gerotor gear set, generally similar to FIG. 1, illustrating the gear set in the single point clearance (SPC) position.
Figure 4:
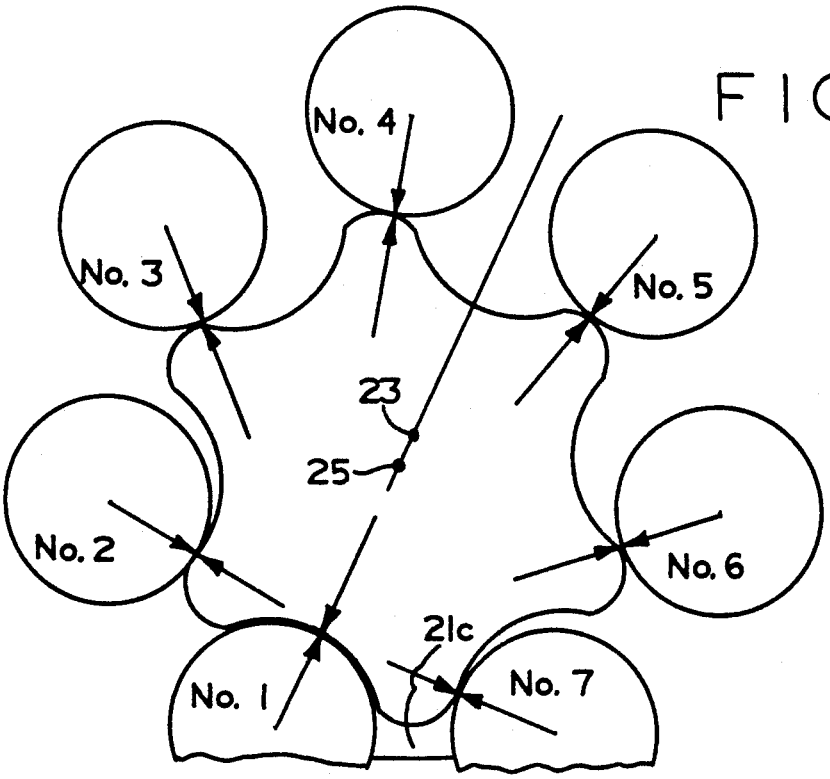
FIG. 4 is an outline view of a gerotor gear set, generally similar to FIG. 1, illustrating the gear set in the double point clearance (DPC) position.

Referring now to FIGS. 3 and 4, there is illustrated an outline view of the gerotor gear set 11, in two different relative rotational positions. One purpose of FIGS. 3 and 4 is to illustrate the various tooth-to-tooth gaps which will be referenced in connection with the numerical example of the present invention, to be presented subsequently. Another purpose of FIGS. 3 and 4 is to illustrate the various gaps, or clearances, which are of primary interest in connection with the ability of the gerotor gear set to seal, or separate, fluid in the contracting volume chambers from fluid in the expanding volume chambers. Referring first to FIG. 3, and assuming clockwise orbital movement of the star 17, the volume chambers 21 on the right side of the line of eccentricity LE are expanding, while the volume chambers on the left side of the line LE are contracting. In FIG. 3, a distance equal to six times the eccentricity (6E) is measured downward from the axis 25, along the line of eccentricity LE. From that point, a line is drawn to the center or axis of each of the rollers or lobes 15. Each of the lines so drawn intersects the profile of the star 17 and of the lobe 15 at the point of "contact" between the star 17 and lobe 15, with each of the lines being perpendicular to a line tangent to both the lobe 15 and the adjacent surface of the star 17. As used herein, the term "contact", in reference to the star and ring lobe merely denotes the point at which they are, instantaneously, at their closest proximity to each other. This is mentioned because the present invention is equally applicable to gerotor gear sets in which the ring and star have a positive clearance therebetween, as well as to gerotor gear sets in which the ring and star have an interference fit (negative clearance) therebetween.

In FIG. 3, the various points of contact (or gaps or clearances) are labeled as No. 1 through No. 7, with the clearance labeled No. 4 comprising a single point clearance SPC, because, with the star 17 in the position shown in FIG. 3, the clearance No. 4 or single point clearance SPC is the only sealing point between the expanding volume chambers on the right side of the line LE and the contracting volume chambers on the left side of the line LE.

Referring still to FIG. 3, it may be seen that the ring lobes 15 and the star 17 appear to be symmetrical about the line of eccentricity LE. Therefore, theoretically and mathematically, gap No. 1 is equal to gap No. 7; gap No. 2 is equal to gap No. 6; and gap No. 3 is equal to gap No. 5.

Referring now to FIG. 4, it may be seen that the star 17 has orbited several degrees counterclockwise from the position shown in FIG. 3. At the instant in time represented in FIG. 3, the ring and star lobes cooperate to define a changeover volume chamber 21c, with the term "changeover" referring to the fact that, instantaneously, the volume chamber 21c is neither expanding nor contracting. Therefore, at the instant represented in FIG. 4, the gaps No. 4 and No. 5 should be equal to each other, and define a clearance which is referred to as a double point clearance DPC, because the gaps No. 4 and No. 5 instantaneously provide two sealing points between the expanding volume chambers and the contracting volume chambers.

Referring still to FIG. 4, it may be seen that the ring lobes 15 and the star 17 are still symmetrical with respect to the line of eccentricity LE. In the position shown in FIG. 4, mathematically gap No. 1 is set to be equal to zero; then gap No. 2 is equal to gap No. 7; gap No. 3 is equal to gap No. 6; and as described previously, gap No. 4 is equal to gap No. 5.

As mentioned in the background of the disclosure, it is an object of the present invention to provide a gerotor design having a constant radial clearance. As will be apparent from the subsequent numerical example of the invention, the term "constant" in reference to the radial clearance between the ring lobes and star profile does not refer to gaps No. 1, 2, 3, 6 and 7, which, as explained previously, are not sealing points. Instead, the term "constant"as used herein in reference to the radial clearance refers only to the single point clearance SPC and the double point clearance DPC. In other words, if the single and double point clearances SPC and DPC are equal, the gerotor gear set may be said to have a "constant radial clearance". It should be apparent to those skilled in the art, and in view of the above description that, as the star 17 orbits and rotates relative to the ring 13, the star profile and the ring lobes define, alternately, a single point clearance (SPC) and a double point clearance (DPC). It is the essence of the present invention to provide a method for selecting the various design parameters of the gerotor gear set which results in a gerotor design in which the SPC and the DPC are, nominally, substantially equal to each other, or at least as close to each other ,as the designer wishes.

Figure 1A:
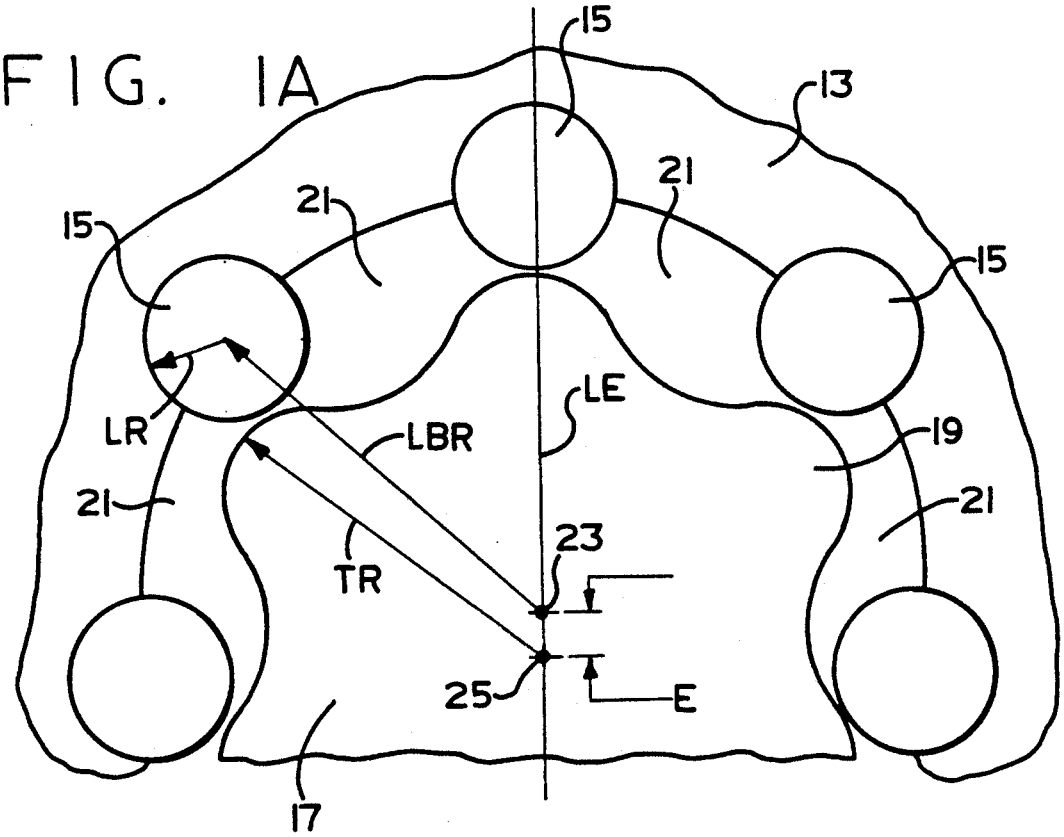
FIG. 1A is an enlarged, fragmentary view similar to FIG. 1.

Referring again to FIGS. 1A and 2, in conjunction with FIGS. 3 and 4, it is well known to those skilled in the art that changing any one of the design parameters such as the tip radius TR, or the lobe base radius LBR, or the generating radius GR, will change the resulting star profile, as well as the clearance (or interference) at the various gaps No. 1 through No. 7. A significant aspect of the present invention is the recognition that changing any one of the above-referenced parameters will have a different effect upon the SPC than upon the DPC, and it is believed that the failure of those skilled in the art to recognize previously this difference has been a major factor in the failure of the prior art to provide a truly constant clearance gerotor gear set, as the term "constant" was defined herein. Therefore, the relationship among the various parameters illustrated in FIGS. 1A and 2 may be expressed by the following equation:

$$LBR+E=TR+gr+TC$$

As an example of the different effect upon the SPC and the DPC of changing one of the gerotor parameters, reference should be made to FIG. 3 which includes, adjacent gap No. 1, a triangle which represents the pressure angle PA at the point of "contact" at gap No. 1. If the generating radius GR would be increased, the result would be narrower external teeth 19. Because of the angle of contact between the star and ring (at gap Nos. 1 and 7), a narrower external tooth 19 can move further outward radially (down in FIG. 3) between the adjacent lobes 15, thus increasing the single point clearance SPC in FIG. 3. However, it may be seen in FIG. 4 that increasing the generating radius GR, and making the external teeth 19 narrower, would have less effect upon the position of the star 17 relative to the ring 13, and therefore, would have much less effect upon the double point clearance DPC than upon the SPC. Similarly, and as will be shown in the subsequent numerical example, a change in either the tip radius TR or the lobe base radius LBR will result in a larger change in the SPC than in the DPC.

The present invention provides a method of selecting design parameters (GR; LBR; TR, etc.) of a gerotor gear set whereby it is possible to achieve a predetermined tip clearance TC (which, as mentioned previously, may be either a positive clearance or an interference). In the method of the present invention, the parameters are initially selected to result in a theoretical tip clearance of zero, i.e., in the absence of manufacturing error, there would be neither a positive clearance nor an interference between the ring and star, but instead, there would be a perfect line-to-line fit between the ring and star throughout the range of relative motion therebetween. However, a tip clearance equal to zero is seldom the goal of the gerotor designer, and the next design step is to change one of the parameters (such as the generating radius GR or the tip radius TR) to achieve the desired tip clearance TC. For example, if a tip clearance TC of −0.001 inches (interference) were desired, one conventional approach would be simply to decrease the generating radius GR by 0.0005 inches. However, as explained previously, and as will be seen in the subsequent numerical example, decreasing the GR by 0.0005 inches will not decrease both the SPC and the DPC by 0.001 inches, and therefore, will not result in a gerotor design having a constant radial clearance. Another conventional approach would be to increase the tip radius TR by 0.0005 inches, in which case the DPC would be fairly close to the desired tip clearance TC of −0.001 inches, but the SPC would not be close to the desired TC. In either case, it should be recognized that factors such as the pressure angle PA and the relative thickness or narrowness of the star tooth will have a substantial effect upon the extent to which SPC and DPC each vary with variations in parameters such as the generating radius GR and the tip radius TR.

It is an important aspect of the present invention to iteratively change one parameter (such as GR) and then another parameter (such as TR or LBR), while constantly monitoring the resultant SPC and DPC, and continuing the iterative process until both the SPC and DPC are substantially equal to the desired tip clearance TC. As used herein, the term "substantially equal" will be understood to mean equal within some acceptable, predetermined tolerance. It will be apparent to those skilled in the art that the method of the present invention merely provides a set of design parameters for the gerotor gear set which mathematically will result in both the SPC and the DPC being equal to the desired tip clearance TC, but not taking into account inaccuracies in the manufacturing process. On the other hand, those skilled in the art will recognize that it is clearly more desirable to start with design parameters which mathematically will provide a constant clearance design than it is to start with parameters which will yield an SPC and an DPC which are different, and then add manufacturing errors to that initial design error.

EXAMPLE

It is believed that the iterative process of the present invention can best be illustrated by way of an actual numerical example of the use of the process. In the example, the initially selected design parameters were as follows:

| | | |
|---|---|---|
| N | = | 6 |
| E | = | .15 inches |
| TR | = | 1.0494 inches |
| GR | = | .4385 inches |
| LBR | = | 1.3379 inches. |
| LR | = | .4385 inches |

As noted previously, the initial design parameters are selected to yield a tip clearance TC which is equal to zero. However, in this example, the desired tip clearance TC is a positive clearance of 0.0040 inches. In practicing the present invention, it is believed to be well within the abilities of one skilled in the art to use any of the commercially available CAD (computer-aided design) systems to take parameters such as those listed above and mathematically generate both the star 17 and the ring 13, and then to position the star in the SPC and DPC positions shown in FIGS. 3 and 4, respectively, and use the CAD software to determine each of the gaps No. 1 through No. 7.

STEP 1

Although the desired tip clearance TC is 0.0040 inches, it is preferred in using the iterative process of the present invention not to change a particular parameter by the entire amount of the desired change in the clearance, but instead, to make a change, in each step, equal to approximately one half of the desired change in the clearance. This is merely preferred, however, and is not essential to the practice of the present invention. In accordance with the above preference, the first step is to reduce the tip radius TR by 0.002 inches to 1.0474 inches. As a result of this change in TR, the gerotor design will now have the following gap dimensions:

| GAP NO. | FIG. 3 | FIG. 4 |
|---|---|---|
| 1 | .0019 inches | .0000 inches |
| 2 | .0039 inches | .0016 inches |
| 3 | .0062 inches | .0031 inches |
| 4 | .0070 inches | .0038 inches |
| 5 | .0062 inches | .0038 inches |
| 6 | .0039 inches | .0031 inches |
| 7 | .0019 inches | .0016 inches |

In accordance with the previous explanation, it maY be seen that decreasing TR by 0.002 inches increased the DPC (gap Nos. 4 and 5, FIG. 4) to 0.0038 inches, very close to the desired TC of 0.0040 inches, but at the same time, increased the SPC (gap No. 4, FIG. 3 to 0.0070 inches, far greater than the desired TC of 0.0040 inches.

STEP 2

In order to bring the SPC somewhat closer, the generating radius GR was then reduced by 0.0010 inches, from 0.4385 inches to 0.4375 inches which, as was explained previously, would tend to make the external teeth 19 somewhat fatter, which should reduce the SPC. As a result of this change in the GR, the DPC was actually reduced somewhat, as would be expected (but only in the fifth decimal place, whereas the numbers in the early steps of the numerical example are carried out only to the fourth decimal place). At the same time, the SPC was reduced from 0.0070 inches to 0.0057 inches.

STEP 3

Because the SPC (which at this point is further from the desired TC than is the DPC) was still 0.0017 inches over the desired TC, the generating radius GR was reduced by an additional 0.0010 inches to 0.4365 inches which, again, left the DPC substantially unchange at 0.0038 inches, but reduced the SPC to 0.0043 inches.

STEP 4

With the SPC now approaching the desired TC of 0.0040 inches, the next step was to reduce the tip radius TR by an amount equal to approximately one half of the difference between the DPC from step 3 and the desired TC. Therefore, the TR was reduced from 1.0474 inches to 1.0473 inches which increased the DPC from 0.0038 inches to 0.0039 inches, but at the same time, resulted in the SPC being increased from 0.0043 inches to 0.0045 inches.

STEP 5

The next step was to further decrease the generating radius GR by approximately the amount of the difference between the SPC from step 4 and the desired TC of 0.0040 inches. Therefore, the generating radius GR was reduced by 0.0005 inches from 0.4365 inches to 0.4360 inches which left the DPC basically unchanged at 0.0039 inches, but reduced the SPC from 0.0045 inches to 0.0038 inches, such that the SPC was then actually below the desired TC.

STEP 6

In order to illustrate more precisely the method of the present invention, in this and subsequent steps, the SPC and DPC will be carried out to five decimal places. Because both the SPC and the DPC are now less than the desired TC, and the SPC is further from the desired TC, in the next step the tip radius TR was decreased by approximately one half of the difference between the desired TC and the DPC from step 4. Therefore, the TR was reduced from 1.047329 to 1.047323 inches, 0.002077 inches less than the original TR, which increased the DPC from 0.00398 inches to 0.00399 inches, and at the same time, increased the SPC from 0.00387 inches to 0.00389 inches.

STEP 7

Because the SPC is still further from the desired TC than is the DPC, in the next step the generating radius GR was increased from 0.4360 inches to inches which increased the DPC from 0.00399 inches to 0.00400 inches, and increased the SPC from 0.00389 inches to 0.00404 inches.

STEP 8

Because the SPC is still further from the desired TC than is the DPC, and is greater than the desired TC, the next step was to decrease the generating radius GR from 0.4361 inches to 0.43607 inches, 0.00243 inches less than the original GR. which basically left the DPC unchanged at 0.00400 inches, while decreasing the SPC from 0.00404 inches to .00400 inches.

As was mentioned previously, the iterative process does not necessarily have to be continued until absolute mathematical equality of SPC and DPC is accomplished, although in the above example, the process was continued until both SPC and DPC were equal to the desired tip clearance TC, out to the fifth decimal place, primarily to illustrate the capability provided by the present invention. However, it should be understood by those skilled in the art that the process could have been stopped several steps earlier, but still have been within the scope of the present invention.

It should also be apparent to those skilled in the art that, although the process has been described as being iterative, it is not an essential feature of the present invention that the changing of the parameters always be done on an alternating basis. Referring back to the above example, in both steps 2 and 3, the generating radius GR was reduced, although one skilled in the art, after utilizing the method of the invention several times, would have probably combined the reductions in GR of steps 2 and 3 into a single step. Similarly, both steps 7 and 8 involved a change of the generating radius GR, step 7 involving an increase in GR (and apparently too much of an increase), followed by step 8 involving a slight decrease in GR. In other words, the change in step 7 resulted in an "overshoot" of the desired TC, and was followed in step 8 by a "correction". Again, one skilled in the art would probably, after having some experience with the present invention, combine the changes of steps 7 and 8 into a single, more appropriate change. However, the changes made in steps 7 and 8 will also be understood to be within the scope of the term "iterative" as used herein.

It will also be understood and appreciated by those skilled in the art that decreasing the lobe radius LR by a certain amount will have approximately the same effect on SPC and DPC as increasing the generating radius GR by the same amount. Similarly, increasing the lobe base radius LBR by a certain amount has approximately the same effect on SPC and DPC as decreasing the tip radius TR by the same amount. Therefore, by means of the present invention, it is possible either to begin with a ring, then design a star to achieve the desired radial clearance, or to begin with a star, and then design a ring to provide the desired radial clearance. It should be noted, however, that whenever an adjustment is made to the lobe radius LR, it is necessary to make a compensating adjustment to the lobe base radius LBR, such that there is no net effect upon the tangent circles of the ring and star.

It should also be appreciated by those skilled in the art that, although the internal teeth or lobes of conventional gerotor and roller gerotor gear sets have circular profiles, the present invention is not so limited. Instead, the internal lobes could have an oval or elliptical profile, while still utilizing the method of the present invention.

The invention has been described in great detail, sufficient to enable one skilled in the art to practice the invention. Obviously, various alterations and modifications will become apparent to those skilled in the art from a reading and understanding of the invention, and it is intended that all such alterations and modifications are part of the present invention, insofar as they come within the scope of the appended claims.

I claim:

1. In a method of selecting design parameters of a gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; theoretical generation of the profile of the inner rotor being accomplished by a theoretical internal tooth of the outer rotor, the theoretical internal tooth having a generating radius GR; relative orbital and rotational motion of the inner and outer rotors defining, alternately, a single point clearance SPC, and a double point clearance DPC between the external teeth of the inner rotor and the internal teeth of the outer rotor; the method being characterized by:

(a) first, selecting the desired radial tip clearance TC between the external teeth of the inner rotor and the internal teeth of the outer rotor, then (b) iteratively, adjusting one of the tip radius TR and the generating radius GR by an amount equal to or less than the difference between the desired tip clearance TC and either the single point clearance SPC or the double point clearance DPC; and (c) repeating step (b) until both the single point clearance SPC and double point clearance DPC are approximately equal to the desired tip clearance TC, within an acceptable tolerance.

2. A gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; the inner rotor having a profile theoretically generated by a theoretical internal tooth of the outer rotor, the theoretical internal tooth having a generating radius GR; relative orbital and rotational motion of the inner and outer rotors defining, alternately, a single point clearance SPC and a double point clearance DPC between the external teeth of the inner rotor and the internal teeth of the outer rotor; the gerotor gear set being characterized by having a design tip radius TR and a design generating radius GR determined in accordance with the following steps:

(a) first, selecting the desired radial tip clearance TC between the external teeth of the inner rotor and the internal teeth of the outer rotor, then (b) iteratively, adjusting one of the tip radius TR and the generating radius GR by an amount equal to or less than the difference between the desired tip clearance TC and either the single point clearance SPC or the double point clearance DPC; and (c) repeating step (b) until both the single point clearance SPC and double point clearance DPC are approximately equal to the desired tip clearance TC, within an acceptable tolerance.

3. In a method of selecting design parameters of a gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; theoretical generation of the profile of one of the rotors being accomplished by a theoretical tooth of the other rotor, the theoretical tooth having a generating radius GR; relative orbital and rotational motion of the inner and outer rotors defining, alternately, a single point clearance SPC, and a double point clearance DPC between the external teeth of the inner rotor and the internal teeth of the outer rotor; the method being characterized by:

first, selecting the desired radial tip clearance TC between the external teeth of the inner rotor and the internal teeth of the outer rotor, then (b) iteratively, adjusting one of the tip radius TR and the generating radius GR by an amount equal to or less than the difference between the desired tip clearance TC and either the single point clearance SPC or the double point clearance DPC; and (c) repeating step (b) until both the single point clearance SPC and double point clearance DPC are approximately equal to the desired tip clearance TC, within an acceptable tolerance.

4. A gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; theoretical generation of the profile of one of the rotors being accomplished by a theoretical tooth of the other rotor, the theoretical tooth having a generating radius GR; relative orbital and rotational motion of the inner and outer rotors defining, alternately, a single point clearance SPC, and a double point clearance DPC between the external teeth of the inner rotor and the internal teeth of the outer rotor; the gerotor gear set being characterized by having a design tip radius TR and a design generating radius GR determined in accordance with the following steps:

(a) first, selecting the desired radial tip clearance TC between the external teeth of the inner rotor and the internal teeth of the outer rotor, then (b) iteratively, adjusting one of the tip radius TR and the generating radius GR by an amount equal to or less than the difference between the desired tip clearance TC and either the single point clearance SPC or the double point clearance DPC; and (c) repeating step (b) until both the single point clearance SPC and double point clearance DPC are approximately equal to the desired tip clearance TC, within an acceptable tolerance.

5. In a method of selecting design parameters of a gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; theoretical generation of the profile of one of the rotors being accomplished by a theoretical tooth of the other rotor, the theoretical tooth having a generating radius GR; relative orbital and rotational motion of the inner and outer rotors defining, alternately, a single point clearance SPC, and a double point clearance DPC between the external teeth of the inner rotor and the internal teeth of the outer rotor; the method being characterized by:

(a) first, selecting the desired radial tip clearance TC between the external teeth of the inner rotor and the internal teeth of the outer rotor, then (b) alternately, adjusting the tip radius TR and the generating radius GR by an amount equal to or less than the difference between the desired tip clearance TC and either the single point clearance SPC or the double point clearance DPC; and (c) repeating step (b) until both the single point clearance SPC and double point clearance DPC are approximately equal to the desired tip clearance TC, within an acceptable tolerance.

6. A gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; theoretical generation of the profile of one of the rotors being accomplished by a theoretical tooth of the other rotor, the theoretical tooth having a generating radius GR; relative orbital and rotational motion of the inner and outer rotors defining, alternately, a single point clearance SPC, and a double point clearance DPC between the external teeth of the inner rotor and the internal teeth of the outer rotor; the gerotor gear set being characterized by having a design tip radius TR and a design generating radius GR determined in accordance with the following steps:

(a) first, selecting the desired radial tip clearance TC between the external teeth of the inner rotor and the internal teeth of the outer rotor, then (b) alternately, adjusting the tip radius TR and the generating radius GR by an amount equal to or less than the difference between the desired tip clearance TC and either the single point clearance SPC or the double point clearance DPC; and (c) repeating step (b) until both the single point clearance SPC and double point clearance DPC are approximately equal to the desired tip clearance TC, within an acceptable tolerance.

7. In a method of selecting design parameters of a gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; theoretical generation of the profile of the inner rotor being accomplished by a theoretical internal tooth of the outer rotor, the theoretical internal tooth having a generating radius GR; relative orbital and rotational motion of the inner and outer rotors defining, alternately, a single point clearance SPC, and a double point clearance DPC between the external teeth of the inner rotor and the internal teeth of the outer rotor; the method being characterized by:

(a) first, selecting the desired radial tip clearance TC between the external teeth of the inner rotor and the internal teeth of the outer rotor, then (b) iteratively, adjusting one of the tip radius TR and the generating radius GR by an amount equal to or less than the difference between the desired tip clearance TC and either the single point clearance SPC or the double point clearance DPC, whichever is further from the desired tip clearance TC; and (c) repeating step (b) until both the single point clearance SPC and double point clearance DPC are approximately equal to the desired tip clearance TC, within an acceptable tolerance.

8. A gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; the inner rotor having a profile theoretically generated by a theoretical internal tooth of the outer rotor, the theoretical internal tooth having a generating radius GR; relative orbital and rotational motion of the inner and outer rotors defining, alternately, a single point clearance SPC and a double point clearance DPC between the external teeth of the inner rotor and the internal teeth of the outer rotor; the gerotor gear set being characterized by having a design tip radius TR and a design generating radius GR determined in accordance with the following steps:

(a) first, selecting the desired radial tip clearance TC between the external teeth of the inner rotor and the internal teeth of the outer rotor, then (b) iteratively, adjusting one of the tip radius TR and the generating radius GR by an amount equal to or less than the difference between the desired tip clearance TC and either the single point clearance SPC or the double point clearance DPC, whichever is further from the desired tip clearance TC; and (c) repeating step (b) until both the single point clearance SPC and double point clearance DPC are approximately equal to the desired tip clearance TC, within an acceptable tolerance.

9. In a method of selecting design parameters of a gerotor gear set of the type including an inner rotor having a plurality N of external teeth defining a tip radius TR, and an outer rotor having a plurality N+1 of internal teeth; the axis of the inner rotor being offset from the axis of the outer rotor by an eccentricity E; theoretical generation of the profile of one of the rotors being accomplished by a theoretical tooth of the other rotor, the theoretical tooth having a generating radius GR; relative orbital and rotational motion of the inner and outer rotors defining, alternately, a single point clearance SPC, and a double point clearance DPC between the external teeth of the inner rotor and the internal teeth of the outer rotor; the method being characterized by:

(a) first, selecting the desired radial tip clearance TC between the external teeth of the inner rotor and the internal teeth of the outer rotor, then (b) iteratively, adjusting one of the lobe base radius LBR and the lobe radius LR by an amount equal to or less than the difference between the desired tip clearance TC and either the single point clearance SPC or the double point clearance DPC; and (c) repeating step (b) until both the single point clearance SPC and double point clearance DPC are approximately equal to the desired tip clearance TC, within an acceptable tolerance.

10. A gerotor gear set of the type including an inner rotor having a Plurality N of external teeth defining a tip radius TR, and an outer rotor having a plurality N+1 of internal teeth; the axis of the inner rotor being offset from the axis of the outer rotor by an eccentricity E; theoretical generation of the profile of one of the rotors being accomplished by a theoretical tooth of the other rotor, the theoretical tooth having a generating radius GR; relative orbital and rotational motion of the inner and outer rotors defining, alternately, a single point clearance SPC, and a double point clearance DPC between the external teeth of the inner rotor and the internal teeth of the outer rotor; the gerotor gear set being characterized by having a design tip radius TR and a design generating radius GR determined in accordance with the following steps:

(a) first, selecting the desired radial tip clearance TC between the external teeth of the inner rotor and the internal teeth of the outer rotor, then iteratively, adjusting one of the lobe base radius LBR and the lobe radius LR by an amount equal to or less than the difference between the desired tip clearance TC and either the single point clearance SPC or the double point clearance DPC; and (c) repeating step (b) until both the single point clearance SPC and double point clearance DPC are approximately equal to the desired tip clearance TC, within an acceptable tolerance.

* * * * *